US009848696B2

(12) United States Patent
Tseng

(10) Patent No.: US 9,848,696 B2
(45) Date of Patent: Dec. 26, 2017

(54) ELECTRIC TABLE STAND, COUPLING THEREOF, AND ELECTRIC TABLE WITH ELECTRIC TABLE STAND

(71) Applicant: TIMOTION TECHNOLOGY CO., LTD., New Taipei (TW)

(72) Inventor: Kuan-Shu Tseng, New Taipei (TW)

(73) Assignee: POWDERMET INC., Euclid, OH (US)

( * ) Notice: Subject to any disclaimer, the term of this patent is extended or adjusted under 35 U.S.C. 154(b) by 0 days.

(21) Appl. No.: 15/249,936

(22) Filed: Aug. 29, 2016

(65) Prior Publication Data

US 2017/0303679 A1 Oct. 26, 2017

(30) Foreign Application Priority Data

Apr. 26, 2016 (TW) ..... 105113002 A
Jul. 28, 2016 (TW) ..... 105123868 A

(51) Int. Cl.
*A47B 9/00* (2006.01)
*A47B 9/04* (2006.01)

(52) U.S. Cl.
CPC ..... *A47B 9/04* (2013.01); *A47B 2009/043* (2013.01)

(58) Field of Classification Search
CPC ..... A47B 9/04; Y10T 403/7026; Y10T 403/7028; Y10T 403/7031; Y10T 403/7032; Y10T 403/7033; Y10T 403/7035; Y10T 403/32991
USPC ..... 108/20, 147; 248/422, 188.2; 403/359.1–359.6
See application file for complete search history.

(56) References Cited

U.S. PATENT DOCUMENTS 1,287,228 A * 12/1918 Christiansen ..... F02N 1/02 123/185.13
2,249,455 A * 7/1941 Bigelow ..... A47B 9/04 108/147
2,368,748 A * 2/1945 Doty ..... A47B 9/04 108/147

(Continued)

FOREIGN PATENT DOCUMENTS

EP 2716180 A1 4/2014
WO 9920152 A1 4/1999

OTHER PUBLICATIONS

Office Action dated Mar. 30, 2017 of the corresponding Denmark patent application.

*Primary Examiner* — Janet M Wilkens
(74) *Attorney, Agent, or Firm* — Chun-Ming Shih; HDLS IPR Services

(57) ABSTRACT

An electric table stand, a coupling thereof, and an electric table with the electric table stand; the electric table stand includes a holder, two support legs, and a transmission apparatus. The two support legs are detachably connected to two ends of the holder and parallel to each other. Each of the support legs includes a screw rod and a first transmission shaft driving the screw rod to rotate. The transmission apparatus is assembled in the holder, and includes a motor, a second transmission shaft driven by the motor and at least one coupling. The coupling includes a first joint connected to the first transmission shaft, a second joint connected to the second transmission shaft, and a flexible body flexibly pushing the second joint to be correspondingly connected to the first joint.

22 Claims, 13 Drawing Sheets

(56) References Cited

U.S. PATENT DOCUMENTS

| | | | | | |
|---|---|---|---|---|---|
| 2,856,218 | A * | 10/1958 | Helsel | G01C 15/06 | 33/293 |
| 4,057,114 | A * | 11/1977 | Anderson | E21B 3/02 | 173/140 |
| 5,195,840 | A * | 3/1993 | Ruschke | F16D 1/101 | 403/229 |
| 7,908,981 | B2 * | 3/2011 | Agee | A47B 9/04 | 108/147 |
| 8,661,989 | B2 * | 3/2014 | Tsai | A47B 9/04 | 108/10 |
| 2001/0037751 | A1 * | 11/2001 | Agee | A47B 9/12 | 108/147 |
| 2002/0043188 | A1 * | 4/2002 | Long | A47B 9/00 | 108/147 |
| 2002/0108544 | A1 * | 8/2002 | Hsu | A47B 9/04 | 108/147.19 |
| 2006/0169862 | A1 * | 8/2006 | Liu | A47B 9/04 | 248/422 |
| 2010/0175592 | A1 * | 7/2010 | Looser | A47B 27/02 | 108/2 |
| 2010/0301186 | A1 * | 12/2010 | Chuang | B66F 3/08 | 248/422 |
| 2016/0345722 | A1 * | 12/2016 | Chen | A47B 9/04 | |

* cited by examiner

ELECTRIC TABLE STAND, COUPLING THEREOF, AND ELECTRIC TABLE WITH ELECTRIC TABLE STAND

TECHNICAL FIELD

The present invention relates to an electric table technology and, in particular, to an electric table stand, a coupling thereof, and an electric table with the electric table stand.

BACKGROUND

By applying an elevator to an electric table, the electric table can fit each user's stature individually and can be adjusted to a desired height as required, so that the user can use the electric table comfortably, and therefore there is a trend to develop the electric table with an elevating function.

A conventional electric table mainly includes a table stand and at least two support legs connected to the table stand. Each support leg has an elevator inside. When each support leg is fixed to the table plate, such a large size is disadvantageous to superpose and put away the electric tables, so it is inconvenient and costly to transport the tables.

In order to solve the above-mentioned problems such as inconvenience in transportation and high transportation fees, the industries employs a separation design on the support legs and the table stand. The support legs and the table stand are driven by a motor and a plurality of transmission shafts. The motor and the transmission shafts are connected by means of a coupling. The only one motor is used to drive each support leg to ascend or descend. However, it is necessary to align and adjust the transmission shafts and solve other problems during the assembly process. Therefore, after buying a batch of desks, the client has to send many technicians to assemble the support legs to a table plate. As a result, assembly is not cost-effective and should be improved.

SUMMARY

It is an object of the present invention to provide an electric table stand, a coupling thereof, and an electric table with the electric table stand. A support leg and a holder can be joined quickly, thus saving labor costs in assembly.

Accordingly, the present invention provides an electric table stand, comprising a holder, at least two support legs and a transmission apparatus. The support legs are detachably connected to two ends of the holder and parallel to each other. Each of the support legs includes a screw rod and a first transmission shaft driving the screw rod to rotate. The transmission apparatus is assembled in the holder. The transmission apparatus includes a motor, a second transmission shaft driven by the motor, and at least one coupling. The coupling includes a first joint connected to the first transmission shaft, a second joint connected to the second transmission shaft, and a flexible body. The flexible body flexibly pushes the second joint to be correspondingly connected to the first joint.

Accordingly, the present invention provides a coupling of an electric table stand, comprising a first joint, a second joint, and a flexible body flexibly pushing to connect the first joint to the second joint.

Accordingly, the present invention provides an electric table, comprising a table plate and an electric table stand. The electric table stand includes a holder, at least two support legs and a transmission apparatus. The holder is fixed to the table plate. Each of the support legs is detachably connected to two ends of the holder and parallel to each other. Each of the support legs includes a screw rod and a first transmission shaft driving the screw rod to rotate. The transmission apparatus is assembled in the holder. The transmission apparatus includes a motor, a second transmission shaft driven by the motor, and at least one coupling. The coupling includes a first joint connected to the first transmission shaft, a second joint connected to the second transmission shaft, and a flexible body. The flexible body flexibly pushes the second joint to be correspondingly connected to the first joint.

Furthermore, the coupling includes a hollow sleeve, an end portion of the hollow sleeve is received in the second joint, and the second transmission shaft is inserted in the hollow sleeve.

The present invention further provides the following effects. By utilizing the coupling disposed between the second transmission shaft and the first transmission shaft, it saves time in aligning and joining the shafts, and thus the holder and each support leg can be joined quickly. Each support leg has the same structure to allow shared use, thus reducing costs in spare parts, stock and stock management in manufacturing the support legs. The first joint is connected to the support leg, and the second joint and the flexible body are connected to the second transmission shaft, so the holder and each support leg can be separately stored and packaged, thus requiring less space in a cargo container and greatly reducing transportation costs. By utilizing the flexible body to push the shaft member to move axially, a second protruding concaved structure is directly engaged into a first protruding concaved structure to achieve automatic assembly, thereby reducing assembly time. In addition to that, there is a larger overlapping area, so stress is uniform, and consequently, noise and vibrations are also reduced. Since the hollow sleeve is engaged into a cylindrical member, when it is desired to assemble the table stand or adjust a length thereof, the hollow sleeve can move along with the cylindrical member simply by pulling the cylindrical member, so the hollow sleeve need not be adjusted individually, thus saving assembly steps and considerable time.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
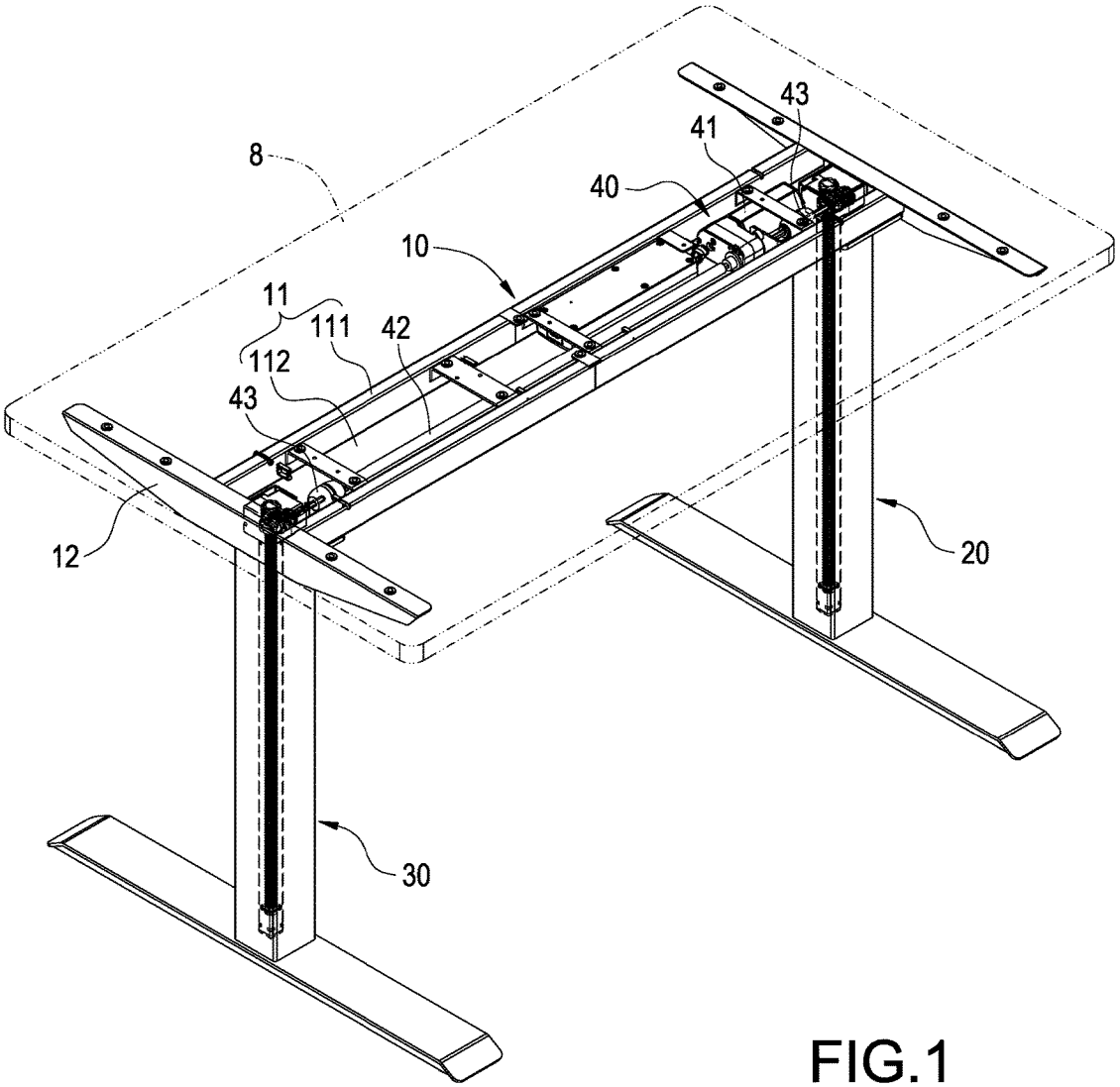
FIG. 1 is a perspective view illustrating an electric table stand of the present invention.
Figure 2:
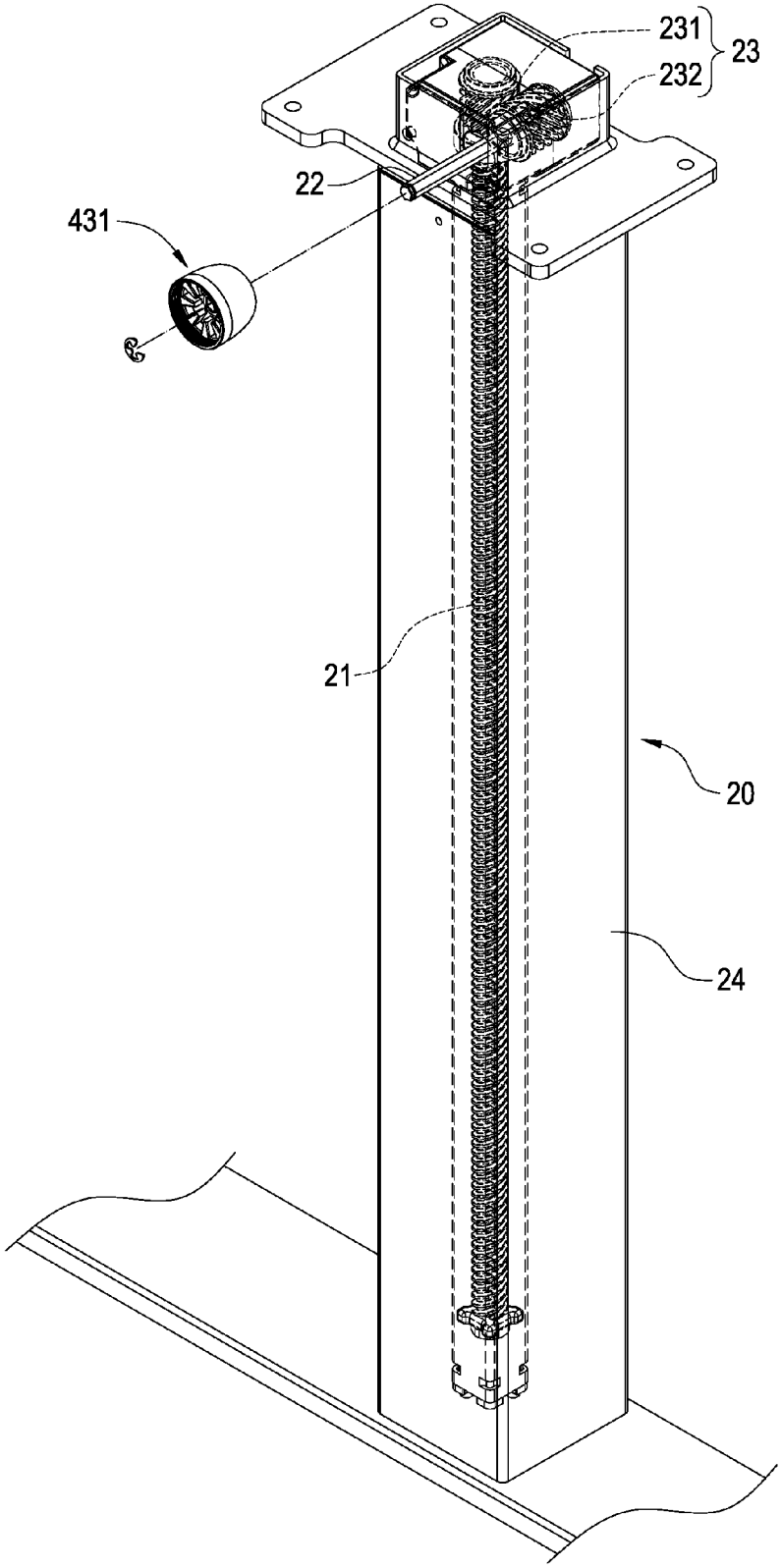
FIG. 2 is an exploded view illustrating the electric table stand of the present invention.

Referring to FIGS. 1 and 2, the present invention provides an electric table stand, a coupling thereof, and an electric table with the electric table stand. The electric table stand comprises a holder 10, at least two support legs 20, 30, and a transmission apparatus 40.

The holder 10 is provided to place a table plate 8. The holder 10 includes a lateral rack 11 and two side wings 12. The lateral rack 11 includes two rectangular tubes 111 arranged in juxtaposed and spaced apart relation and includes an accommodating recess 112 between the rectangular tubes 111. The two side wings 12 are connected to a front end and a tail end of the lateral rack 11, respectively, so that the holder 10 is substantially in an I-shaped configuration.

Figure 7:
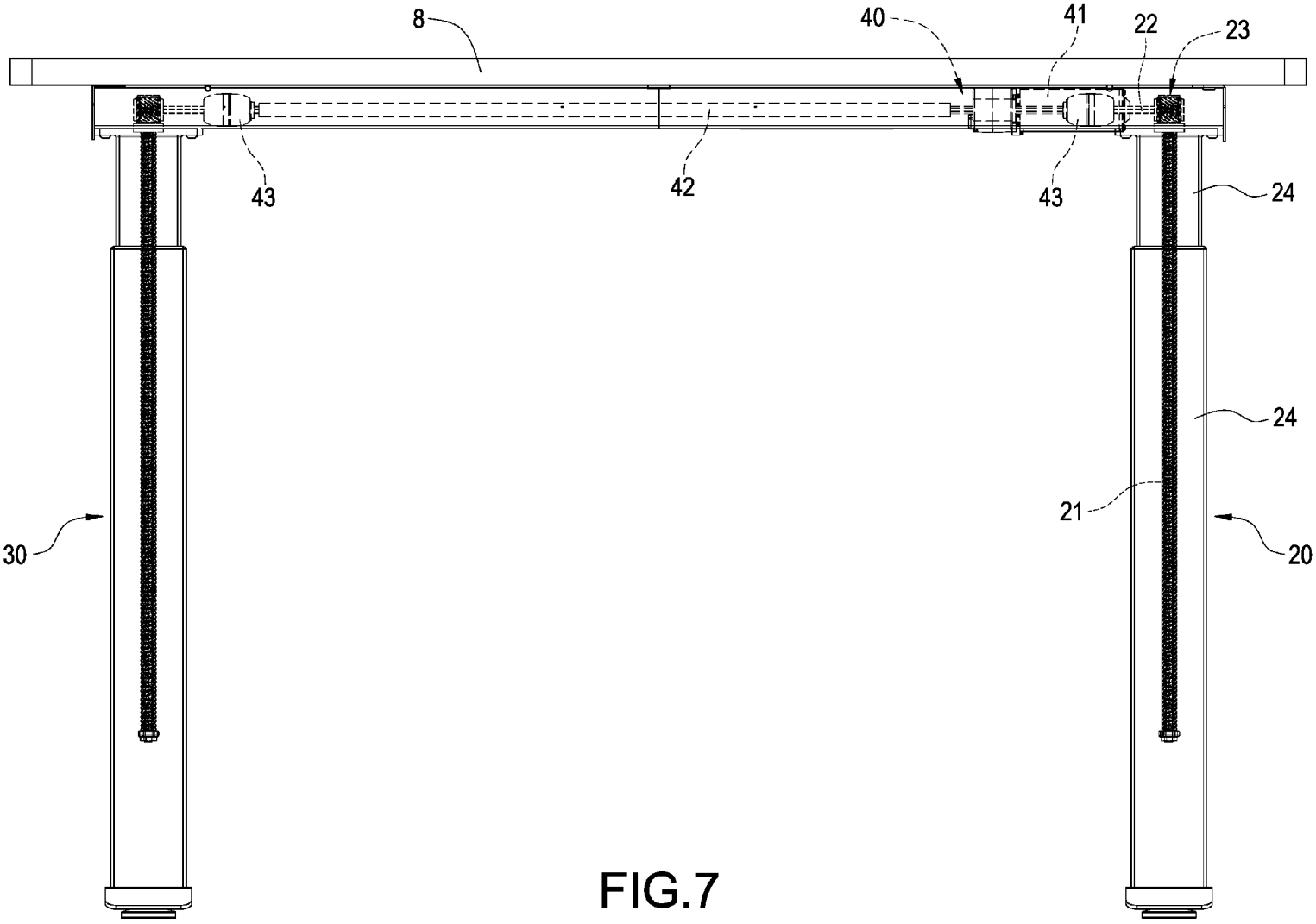
FIG. 7 is a schematic view illustrating the electric table stand in use.

The support legs 20, 30 are detachably connected to two ends of the holder 10 and are parallel to each other. The support legs 20, 30 can be fixed by means of screw bolts or other fastening elements. The support leg 20 includes a screw rod 21, a first transmission shaft 22, a bevel gear set 23, and a plurality of telescopic tubes 24. The telescopic tubes 24 are nested one within another, and by means of connection, the screw rod 21 drives relative movement between the telescopic tubes 24 (as shown in FIG. 7). The bevel gear set 23 includes a first gear 231 connected to a top end of the screw rod 21, and includes a second gear 232 connected to one end of the first transmission shaft 22. The gears 231, 232 can be bevel gears, helical gears and etc. The first gear 231 and the second gear 232 engagedly drive each other. The first transmission shaft 22 can has a regular hexagonal cross-section.

The other support leg 30 has the same structure as the foregoing support leg 20, so any repetitive detailed description thereof is omitted. This configuration enables shared use of components and greatly reduces costs in spare parts, stock and stock management in manufacturing the support legs 20, 30.

The transmission apparatus 40 is assembled in the holder 10. The transmission apparatus 40 includes a motor 41, a second transmission shaft 42 and a coupling 43. The motor 41 is hidden, received and fixed in the accommodating recess 112. The second transmission shaft 42 is parallel to each of the rectangular tubes 111 and is disposed at one side of the motor 41. The motor 41 drives the second transmission shaft 42 to rotate by means of a gear set (not illustrated).

Figure 3:
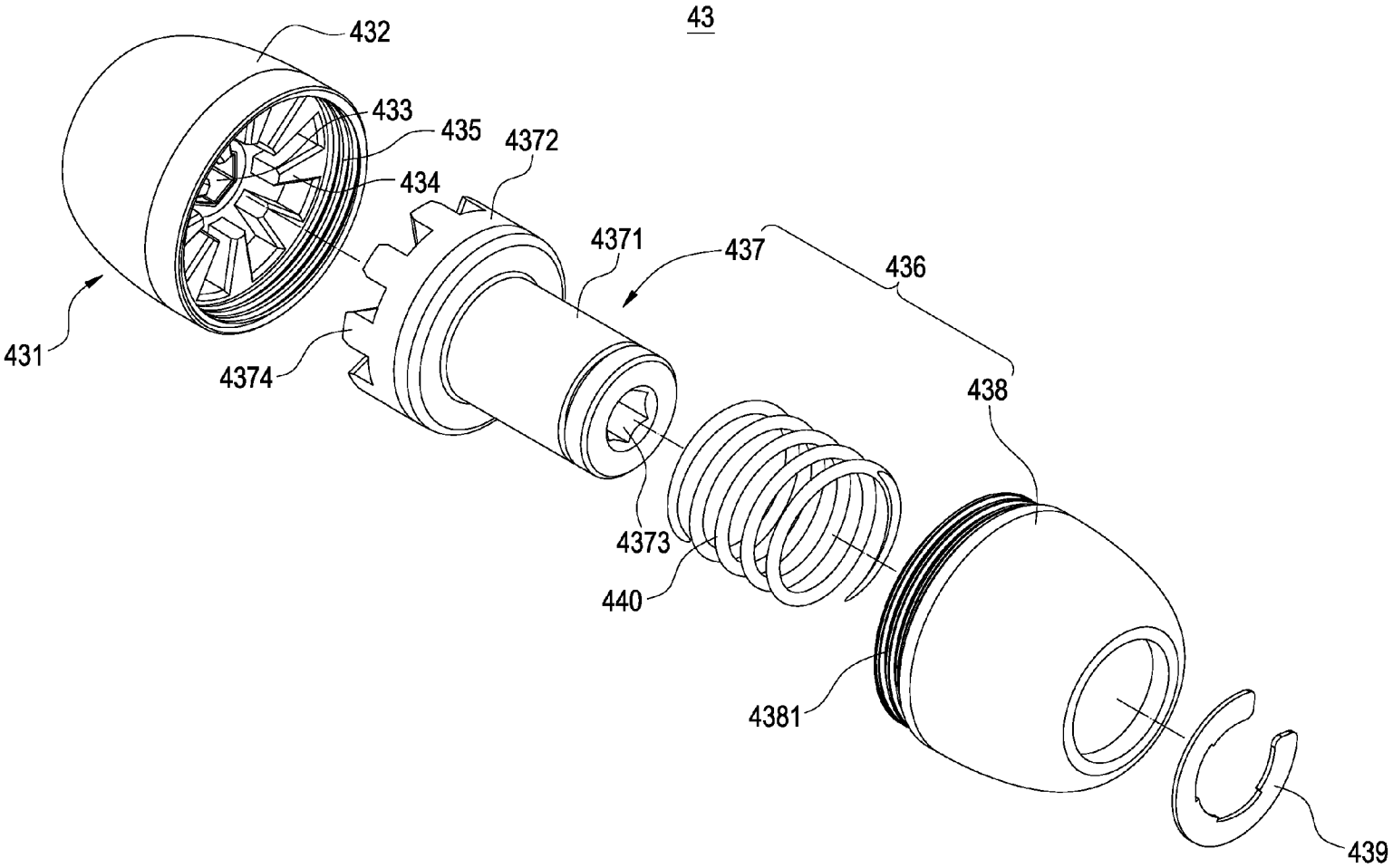
FIG. 3 is a perspective exploded view illustrating a coupling of the present invention.
Figure 4:
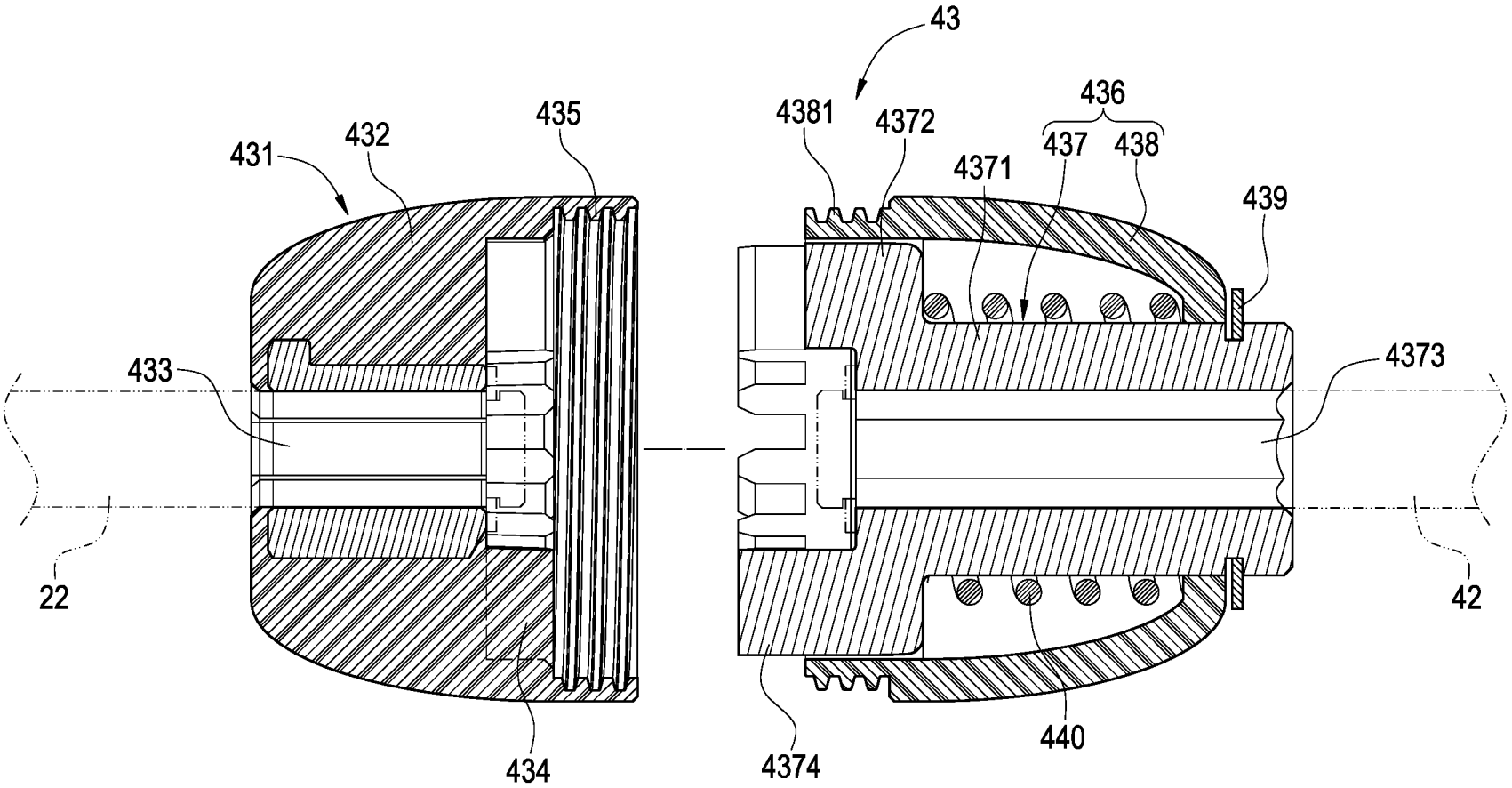
FIG. 4 is a cross-sectional view illustrating the coupling before connection.
Figure 5:
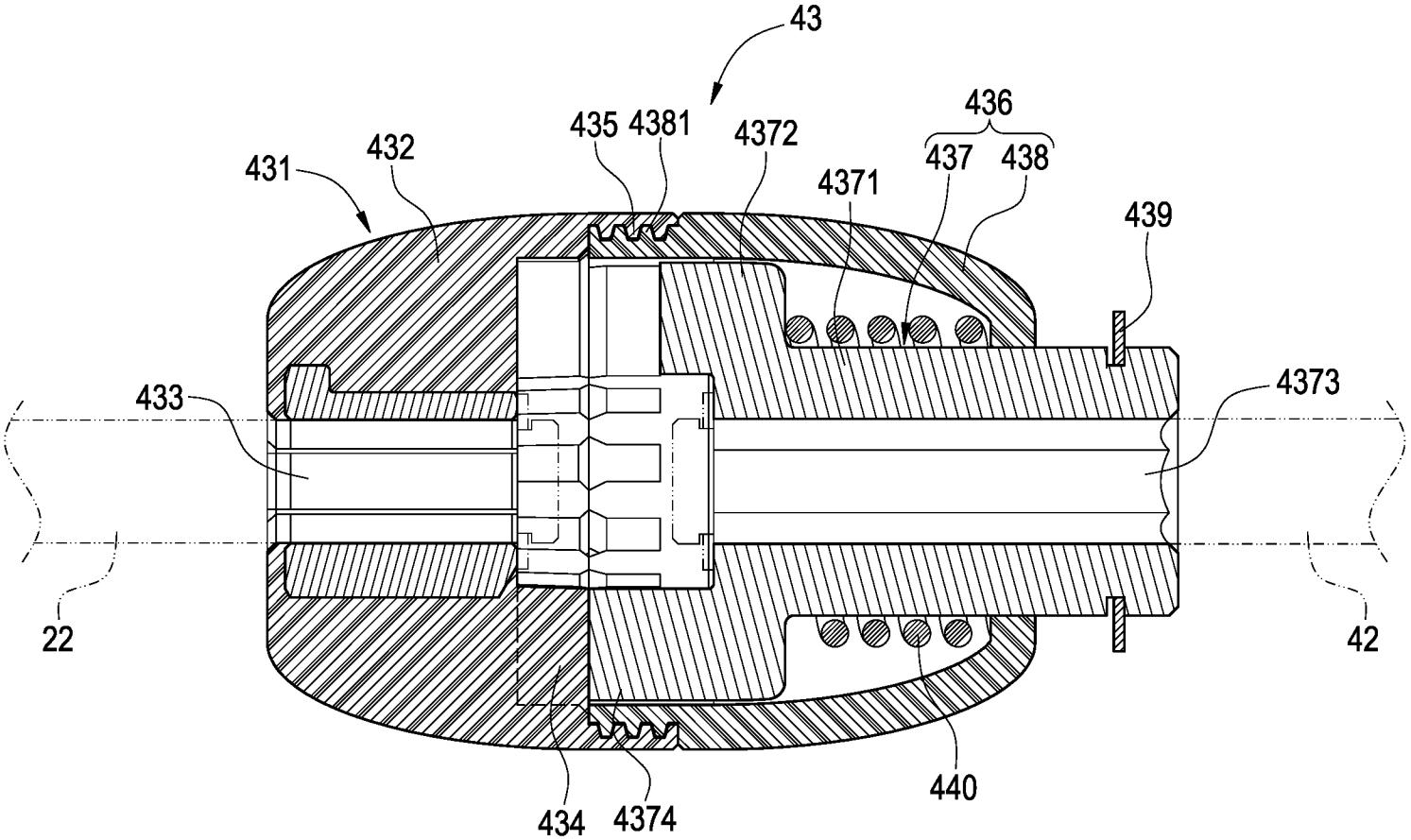
FIG. 5 is a cross-sectional view illustrating the coupling after connection.
Figure 6:
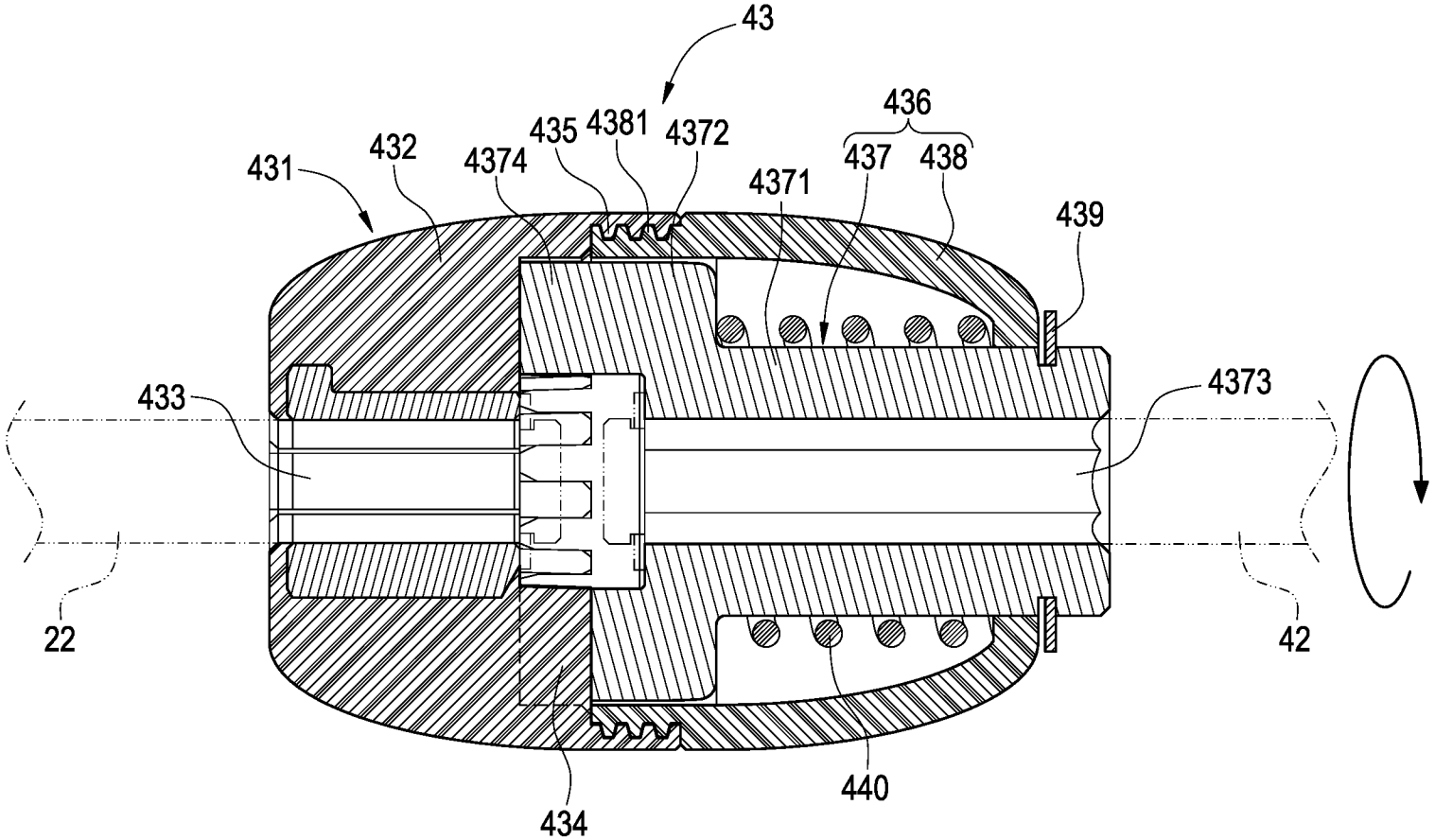
FIG. 6 is a cross-sectional view illustrating that the joints of the coupling after they are connected.

Referring to FIGS. 3 and 4, after assembly, the coupling 43 of the present embodiment substantially has an egg shape. The coupling 43 includes a first joint 431, a second joint 436 and a flexible body 440. The first joint 431 has a half housing 432. A through hole 433 is formed at a center of the half housing 432, and the through hole 433 has a shape corresponding to the shape of the first transmission shaft 22, thereby facilitating insertion and connection of the first transmission shaft 22 with the half housing 432. A first protruding concaved structure 434 and an internal thread 435 are disposed at one side inside the half housing 432.

The second joint 436 includes a shaft member 437 and a half-housing member 438. The shaft member 437 includes a shaft rod section 4371 and a joint section 4372 extending outwardly from one end of the shaft rod section 4371. An axial hole 4373 passing through the shaft rod section 4371 and the joint section 4372 is disposed at a center of the shaft member 437, and the axial hole 4373 is provided for insertion of the second transmission shaft 42. An end portion of the joint section 4372 includes a second protruding concaved structure 4374 corresponding to the first protruding concaved structure 434 for engagement with the each other. The shaft rod section 4371 is connected to a fastener 439 at one side of the shaft rod section 4371 away from the joint section 4372.

An external thread 4381 is disposed at one side of the half-housing member 438 for threadedly fastened to the internal thread 435. The half-housing member 438 externally encloses the shaft member 437 and is blocked by the fastener 439. The flexible body 440 is a compression coil spring, and the flexible body 440 is enclosingly disposed at an outer circumferential surface of the shaft rod section 4371 and is flexibly disposed between the joint section 4372 and the half-housing member 438.

Referring to FIGS. 1, 2, 5, and 6, the first joint 431 is connected to the support leg 20 by means of a fastening ring, thereby achieving individual packaging and storage. The second joint 436 and the flexible body 440 are connected to the second transmission shaft 42, thereby facilitating individual packaging and storage. When assembling, the support legs 20, 30 are assembled to the holder 10 first, and then the external thread 4381 of the half-housing member 438 is threadedly fastened to the internal thread 435 of the half housing 432. At this point, the shaft member 437 is pushed toward the first protruding concaved structure 434 by an elastic force of the flexible body 440, so that an end face of the second protruding concaved structure 4374 is in contact with an end face of the first protruding concaved structure 434 (see FIG. 5), but at this moment the second protruding concaved structure 4374 is not assembled to the first protruding concaved structure 434 since the half-housing member 438 is hindered by the first joint 431 and is immobile along with the first joint 431.

When the motor 41 is powered on to rotate, the motor 41 drives the second transmission shaft 42 to rotate and at the same time drives the shaft member 437 to rotate. The shaft member 437 is pushed toward the first protruding concaved structure 434 by the elastic force of the flexible body 440, and therefore, upon rotation of the shaft member 437, the second protruding concaved structure 4374 is aligned with the first protruding concaved structure 434. Then, because the flexible body 440 pushes the shaft member 437 to move axially, the second protruding concaved structure 4374 is directly engaged into the first protruding concaved structure 434 to achieve automatic assembly.

Referring to FIG. 7, the present invention can include two couplings 43, just like the present embodiment, or can include only one coupling 43. The second transmission shaft 42 can include a hollow sleeve formed in a middle area and also include a hexagonal rod body connected to two ends of the hollow sleeve, as in the present embodiment, or alternatively the second transmission shaft 42 can be in a form of the hollow sleeve only or can be in a form of the hexagonal rod body. The motor 41 drives the second transmission shaft 42 to rotate, and each coupling 43 is connected to the second transmission shaft 42 and the first transmission shaft 22 of each of the support legs 20, 30, so the first transmission shaft 22 drives the bevel gear set 23 to make the screw rod 21 rotate, and thereby telescopic tubes 24 can extend or retract to adjust a height of the table plate 8.

Figure 8:
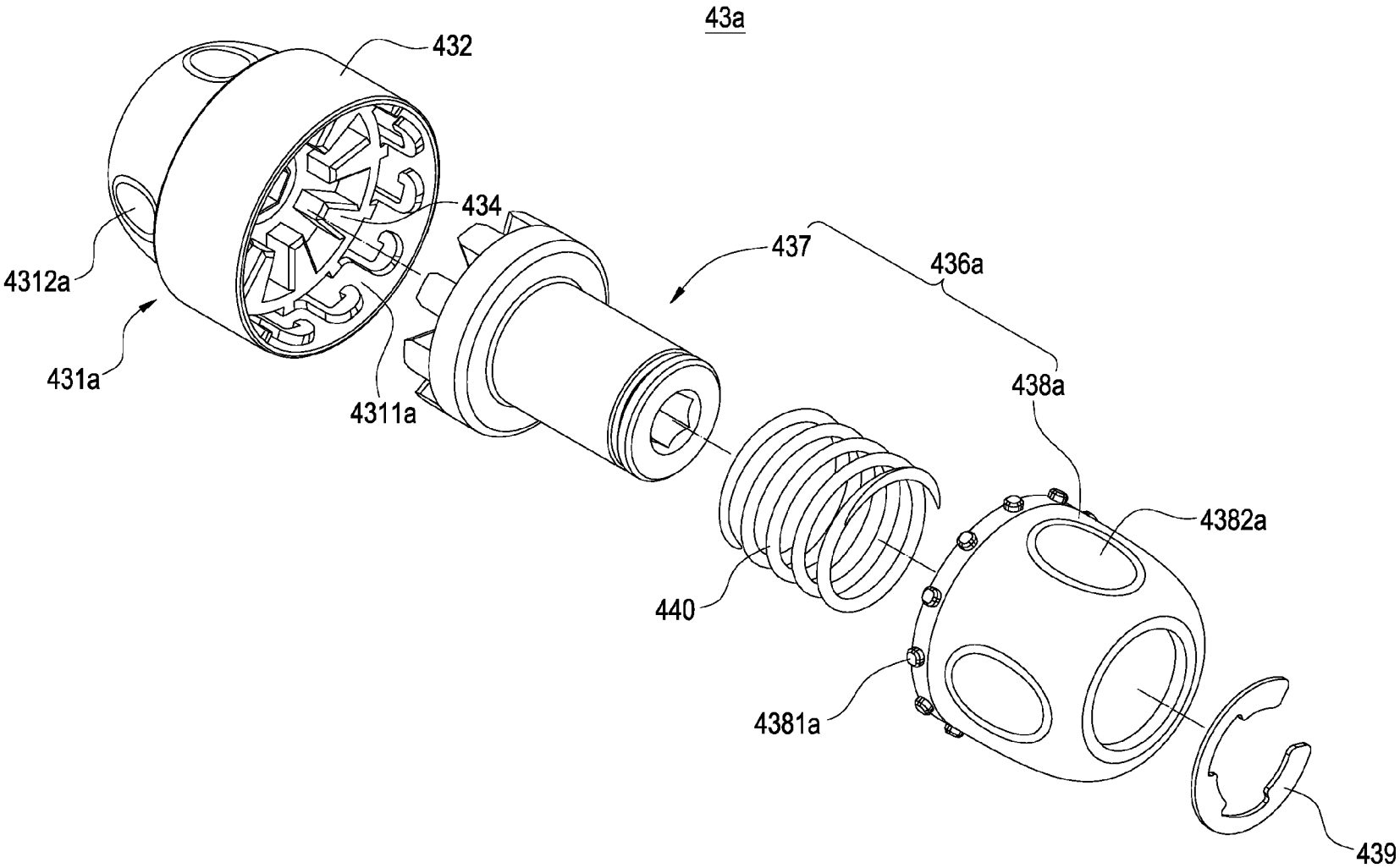
FIG. 8 is a perspective exploded view illustrating the coupling according to another embodiment of the present invention.

Referring to FIG. 8, the difference between the present embodiment and the previous embodiment is as follows. The coupling 43*a* of the present embodiment includes a first joint 431*a*, a second joint 436*a* and a flexible body 440. The first joint 431*a* also includes a half housing 432. The half housing 432 includes the through hole 433 and the first protruding concaved structure 434 mentioned in the previous embodiment, and the half housing 432 further includes a plurality of guiding positioning structures 4311*a* disposed at the half housing 432. The second joint 436*a* also includes a shaft member 437 and a half-housing member 438*a*. A plurality of protruding pillars 4381*a* extend from an outer circumferential surface of the half-housing member 438*a*, and each of the protruding pillars 4381*a* is correspondingly engaged with each of the guiding positioning structures 4311*a*, and thereby the half-housing member 438*a* and the first joint 431*a* can be joined quickly. An outer circumferential surface of the half housing 432 includes a plurality of indentations 4312*a*, and the outer circumferential surface of the half-housing member 438*a* includes a plurality of indentations 4382*a*, thereby facilitating clamping and rotation during assembly.

Figure 9:
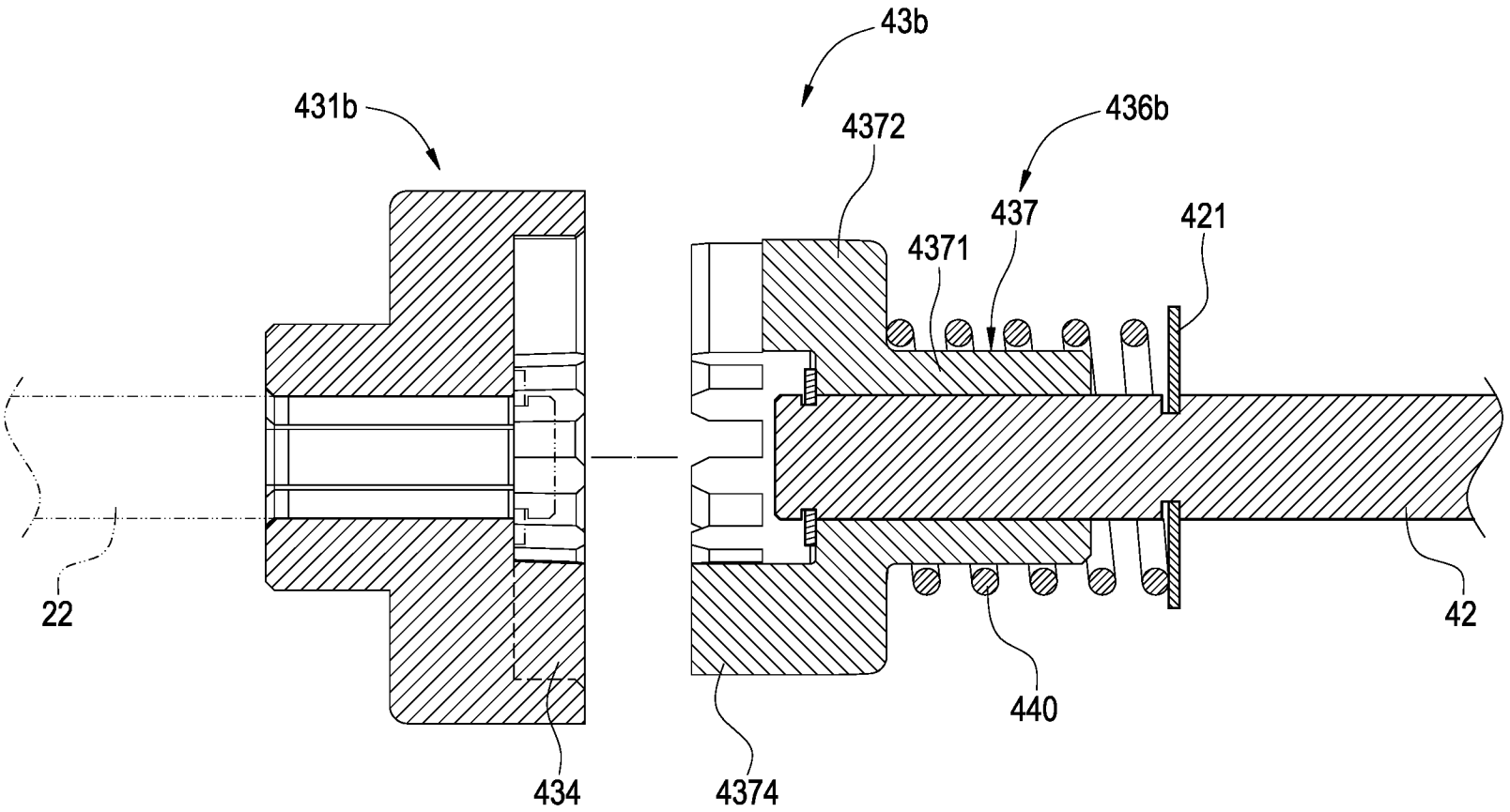
FIG. 9 is a cross-sectional view illustrating the coupling before connection according to still another embodiment of the present invention.

Referring to FIG. 9, in this embodiment, a coupling 43*b* includes a first joint 431*b*, a second joint 436*b* and a flexible body 440. The first joint 431*b* only includes the through hole 433 and the first protruding concaved structure 434 of the foregoing embodiment. The second joint 436*b* only includes a shaft member 437. The shaft member 437 includes a shaft rod section 4371 and a joint section 4372 extending outwardly from one end of the shaft rod section 4371, an end portion of the joint section 4372 includes a second protruding concaved structure 4374 corresponding to the first protruding concaved structure 434, the shaft member 437 receives the second transmission shaft 42 and is slidable at the second transmission shaft 42, the second transmission shaft 42 is connected to a C-shaped fastening ring 421, and the flexible body 440 is enclosingly disposed at an outer circumferential surface of the shaft rod section 4371 and is flexibly disposed between the joint section 4372 and the C-shaped fastening ring 421. Therefore, the present embodiment has the same effects as the above-mentioned embodiments.

Figure 10:
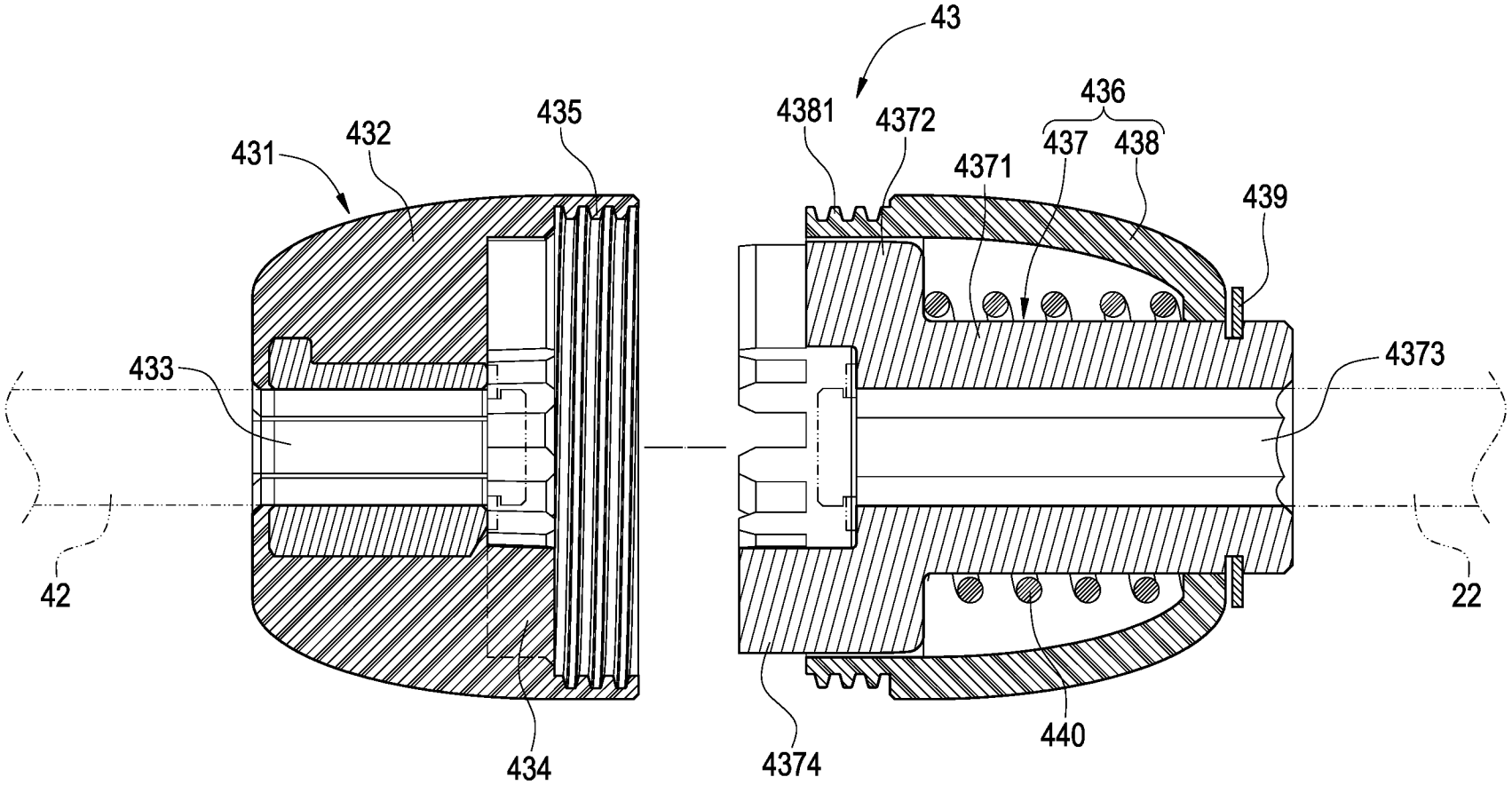
FIG. 10 is a cross-sectional view illustrating the electric table stand according to another embodiment of the present invention.

Referring to FIG. 10, besides the above-mentioned regarding the electric table stand of the present embodiment, alternatively, the second joint 436 of the coupling 43 can be connected to the first transmission shaft 22, and the first joint 431 is connected to the second transmission shaft 42. The flexible body 440 flexibly pushes the first joint 431 to be correspondingly connected to the second joint 436. Namely, compared to the foregoing embodiment, the first transmission shaft, the second transmission shaft, the first joint, and the second joint are connected differently in an interchanged manner, which also falls within the protection scope of the present invention.

Figure 11:
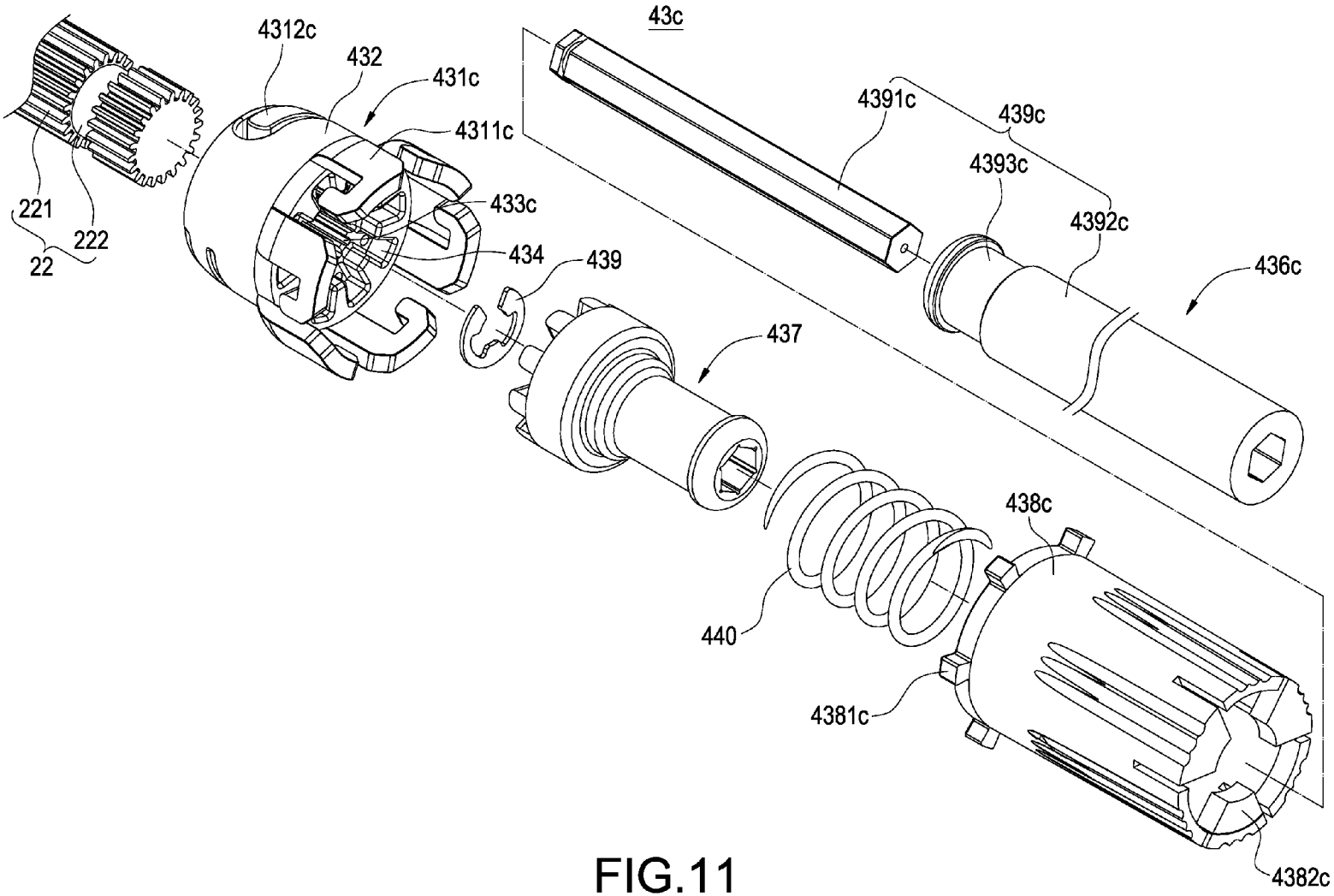
FIG. 11 is a perspective exploded view illustrating the coupling according to yet another embodiment of the present invention.
Figure 12:
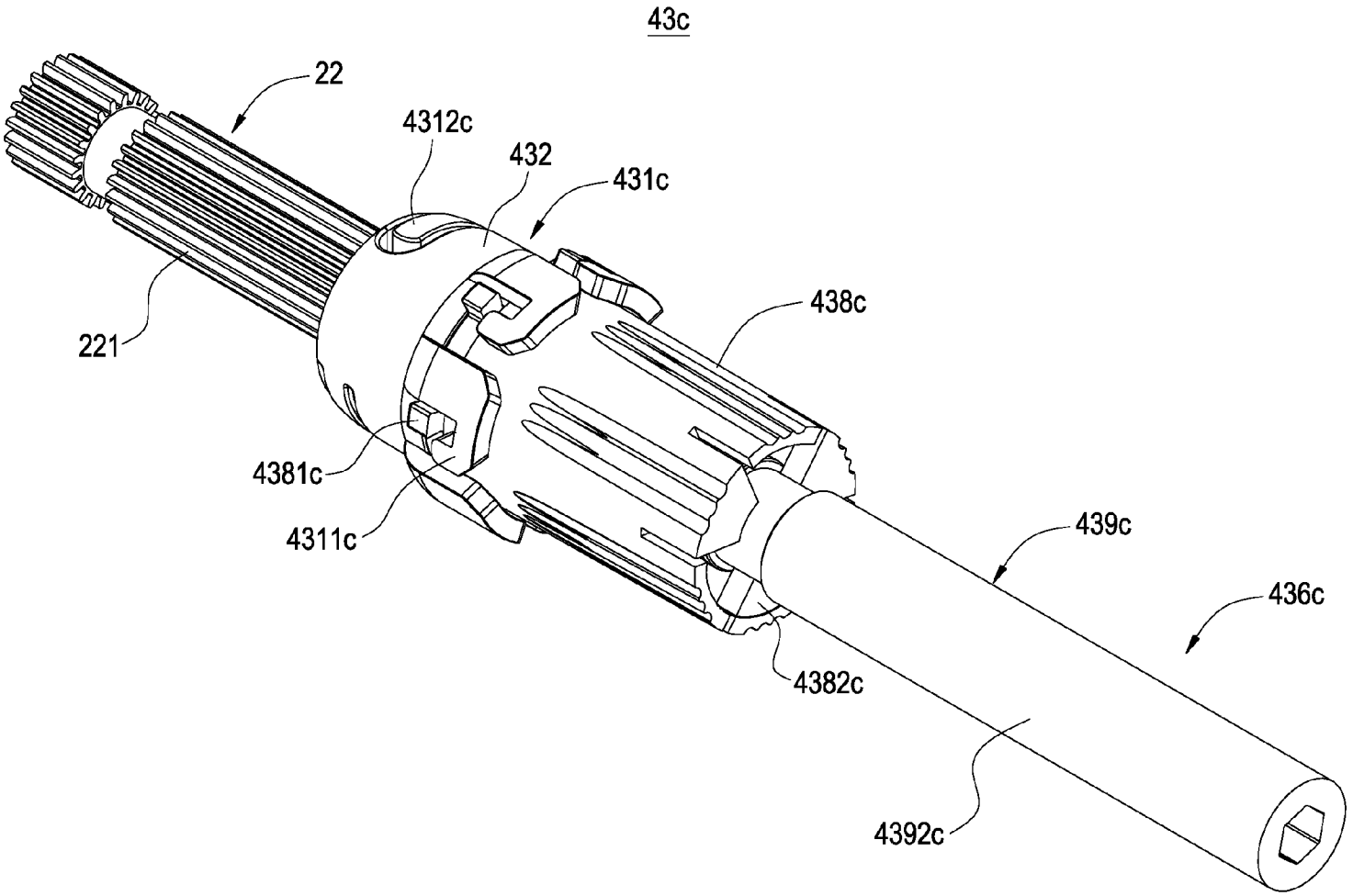
FIG. 12 is an assembled view illustrating the coupling according to the yet another embodiment of the present invention.
Figure 13:
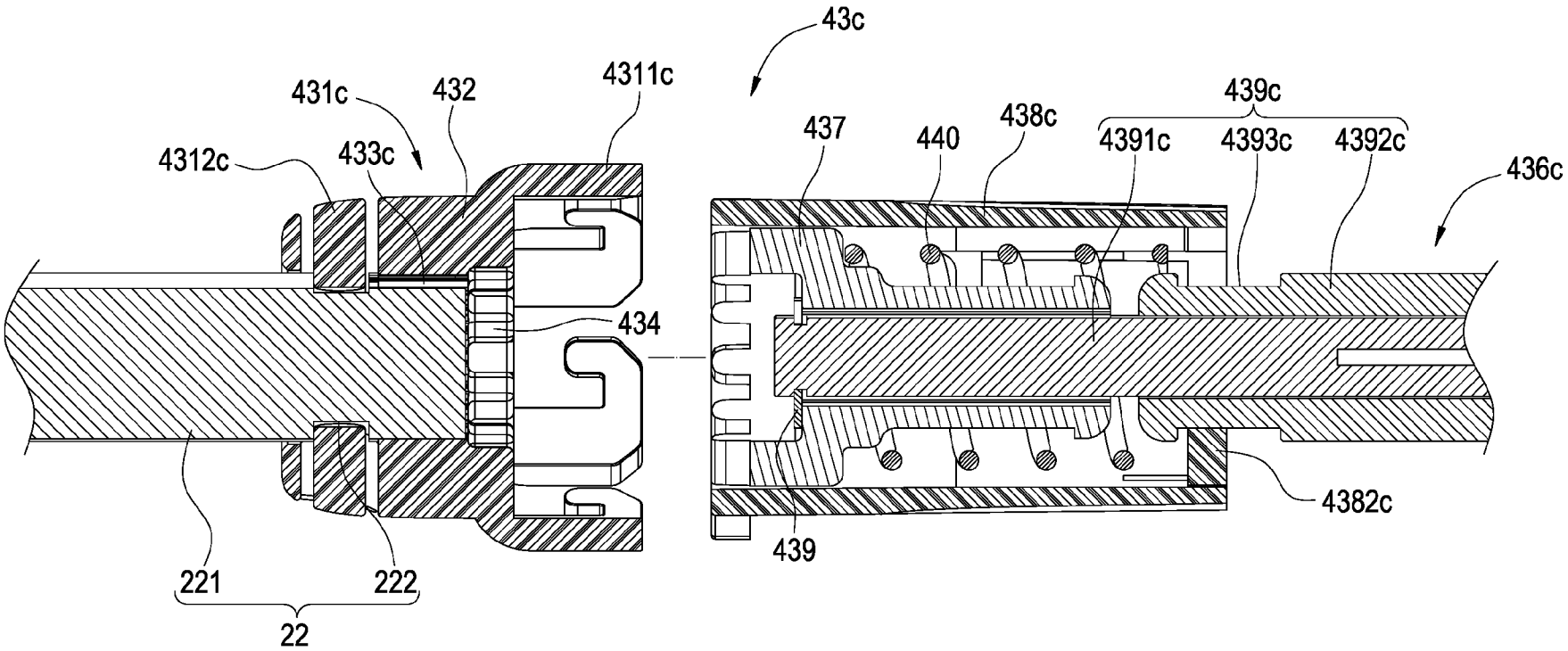
FIG. 13 is an assembled cross-sectional view illustrating the coupling according to the yet another embodiment of the present invention.

Referring to FIGS. 11 to 13, a coupling 43*c* of the present embodiment includes a first joint 431*c*, a second joint 436*c*, and a flexible body 440. The first joint 431*c* includes a half housing 432, a first protruding concaved structure 434 is disposed inside the half housing 432, a plurality of guiding positioning structures 4311*c* are disposed at the half housing 432, a flexible fastening ring 4312*c* is disposed at one side of the half housing 432 away from each guiding positioning structure 4311*c*, and the flexible fastening ring 4312*c* has a C shape. The first transmission shaft 22, besides having a regular hexagonal cross-section, can also have a plurality of gear rods 221 on its surface, and a positioning recess 222 is disposed between each gear rod 221, as in the present embodiment. The half housing 432 includes a toothed hole 433*c* at its center for engagement with each of the gear rods 221, and the flexible fastening ring 4312*c* is correspondingly engaged with the positioning recess 222.

The second joint 436*c* includes a shaft member 437, a cylindrical member 438*c*, and a rod assembly 439*c*. A plurality of bumps 4381*c* extend from an outer circumferential edge of the cylindrical member 438*c*, each of the bumps 4381*c* is correspondingly engaged with each of the guiding positioning structures 4311*c* for achieving quick engagement of the cylindrical member 438*c* with the first joint 431*c*. A plurality of flexible arms 4382*c* is disposed on one end of the cylindrical member 438*c* away from each of the bumps 4381*c*, and the flexible arm 4382*c* has an L-shaped cross-section. The rod assembly 439*c* includes a rod body 4391*c* and a hollow sleeve 4392*c*. The rod body 4391*c* has a regular hexagonal cross-section. The hollow sleeve 4392*c* includes a narrow section 4393*c* at a front end, and a rear end of the hollow sleeve 4392*c* is configured for insertion of the second transmission shaft 42 (not illustrated).

For assembling the second joint 436*c*, the flexible body 440 receives the shaft member 437, and both of them are disposed inside the cylindrical member 438*c*, the fastener 439 is fastened to one end of the rod body 4391*c*, the other end of the rod body 4391*c* is inserted into the shaft member 437 and protrudes out from a center of the cylindrical member 438*c*. After that, the hollow sleeve 4392*c* correspondingly receives, by its central hole, a portion of the rod body 4391*c* protruding out of the cylindrical member 438*c*, and the hollow sleeve 4392*c* is pressed into the cylindrical member 438*c* and is engaged therein, so that each flexible arm 4382*c* is engaged with the narrow section 4393*c* and positioned. At last, a fastening member (not illustrated) is assembled onto a rear end face of the rod body 4391*c*, so as to fix and couple the rod body 4391*c* and the hollow sleeve 4392*c* together.

When assembling, first the gear rods 221 of the first transmission shaft 22 are engaged with the toothed hole 433*c* of the first joint 431*c*, and the flexible fastening ring 4312*c* is correspondingly engaged with the positioning recess 222. Then, the second transmission shaft 42 (not illustrated) is inserted into the central hole of the hollow sleeve 4392*c*. When joining, each of the bumps 4381*c* of the cylindrical member 438*c* is correspondingly engaged with each of the guiding positioning structures 4311*c* and is positioned after rotated. At this point, the second protruding concaved structure 4374 (as shown in FIG. 3) of the shaft member 437 is not coupled to the first protruding concaved structure 434. After the motor 41 is powered on to rotate, the motor 41 drives the second transmission shaft 42 to rotate and at the same time drives the shaft member 437 to rotate. The shaft member 437 is pushed by the elastic force of the flexible body 440, and therefore, upon rotation of the shaft member 437, the shaft member 437 moves axially, and thereby the second protruding concaved structure 4374 of the shaft member 437 is engaged into the first protruding concaved structure 434 to achieve automatic assembly.

In summary, the electric table stand, the coupling thereof, and the electric table with the electric table stand of the present invention certainly can achieve anticipated objectives and solve the conventional defects. The present invention also has novelty and non-obviousness, so the present invention completely complies with the requirements of patentability. Therefore, a request to patent the present invention is filed pursuant to patent law. Examination is kindly requested, and allowance of the present application is solicited to protect the rights of the inventor.

What is claimed is:

1. An electric table stand, comprising:

a holder;

at least two support legs detachably connected to two ends of the holder and parallel to each other, each of the support legs including a screw rod and a first transmission shaft driving the screw rod to rotate; and a transmission apparatus assembled in the holder, the transmission apparatus including a motor, a second transmission shaft driven by the motor, and at least one coupling, the coupling including a first joint connected to the first transmission shaft, a second joint connected to the second transmission shaft, and a flexible body, the flexible body flexibly pushing the second joint to be correspondingly connected to the first joint, wherein the second joint and the first joint are connected after the motor drives the second transmission shaft to rotate.

2. The electric table stand of claim 1, wherein the first joint includes a half housing, a first protruding concaved structure is disposed inside the half housing, the second joint includes a shaft member, the shaft member includes a shaft rod section and a joint section extending from one end of the shaft rod section, and an end portion of the joint section includes a second protruding concaved structure corresponding to the first protruding concaved structure for engagement with each other.

3. The electric table stand of claim 2, wherein the second joint further includes a half-housing member, an internal thread is disposed inside the half housing, and an external thread is disposed at one side of the half-housing member for threadedly fastened to the internal thread.

4. The electric table stand of claim 3, wherein the shaft rod section is connected to a fastener at one side of the shaft rod section away from the joint section, the half-housing member externally encloses the shaft member and is blocked by the fastener, and the flexible body is enclosingly disposed at an outer circumferential surface of the shaft rod section and is flexibly disposed between the joint section and the half-housing member.

5. The electric table stand of claim 2, wherein a through hole is formed at a center of the half housing, and the through hole is provided for insertion of the first transmission shaft.

6. The electric table stand of claim 2, wherein an axial hole passing through the shaft rod section and the joint section is disposed at a center of the shaft member, and the axial hole is provided for insertion of the second transmission shaft.

7. The electric table stand of claim 2, wherein the second joint further includes a half-housing member, a plurality of guiding positioning structures are disposed at the half housing, a plurality of protruding pillars extend from an outer circumferential surface of the half-housing member, and each of the protruding pillars is correspondingly engaged with each of the guiding positioning structures.

8. The electric table stand of claim 7, wherein an outer circumferential surface of the half housing and the outer circumferential surface of the half-housing member include a plurality of indentations.

9. The electric table stand of claim 2, wherein the shaft member receives the second transmission shaft and is slidable at the second transmission shaft, the second transmission shaft is connected to a C-shaped fastening ring, and the flexible body is enclosingly disposed at an outer circumferential surface of the shaft rod section and is flexibly disposed between the joint section and the C-shaped fastening ring.

10. The electric table stand of claim 2, wherein a flexible fastening ring is disposed at one side of the half housing, a plurality of gear rods are disposed on a surface of the first transmission shaft, a positioning recess is disposed between each of the gear rods, the half housing includes a toothed hole for engagement with each of the gear rods, and the flexible fastening ring is correspondingly engaged with the positioning recess.

11. The electric table stand of claim 1, wherein the support leg includes a bevel gear set and a plurality of telescopic tubes, the telescopic tubes are nested one within another, by means of connecting and driving of the screw rod to cause relative movement between the telescopic tubes, the bevel gear set includes a first gear connected to one end of the screw rod and a second gear connected to one end of the first transmission shaft, and the first gear and the second gear engagedly drive each other.

12. The electric table stand of claim 1, wherein the holder includes a lateral rack and two side wings, the lateral rack includes two rectangular tubes arranged in juxtaposed and spaced apart relation and includes an accommodating recess between the rectangular tubes, the two side wings are connected to two ends of the lateral rack respectively, the motor is hidden, received and fixed in the accommodating recess, and the second transmission shaft is parallel to each of the rectangular tubes and is disposed at one side of the motor.

13. An electric table, comprising:

a table plate; and an electric table stand, comprising:

a holder;

at least two support legs detachably connected to two ends of the holder and parallel to each other, each of the support legs including a screw rod and a first transmission shaft driving the screw rod to rotate; and a transmission apparatus the transmission apparatus including a motor, a second transmission shaft driven by the motor, and at least one coupling, the coupling including a first joint connected to the first transmission shaft, a second joint connected to the second transmission shaft, and a flexible body flexibly pushing the second joint to be correspondingly connected to the first joint, wherein the second joint and the first joint are connected after the motor drives the second transmission shaft to rotate.

14. A coupling of an electric table stand, comprising a first joint, a second joint, and a flexible body flexibly pushing to connect the first joint to the second joint, wherein the first joint includes a half housing, a first protruding concaved structure is disposed inside the half housing, the second joint includes a shaft member, the shaft member includes a shaft rod section and a joint section extending from one end of the shaft rod section, and an end portion of the joint section includes a second protruding concaved structure corresponding to the first protruding concaved structure for engagement with each other.

15. The coupling of the electric table stand of claim 14, wherein the second joint further includes a half-housing member, an internal thread is disposed inside the half housing, and an external thread is disposed at one side of the half-housing member for threadedly fastened to the internal thread.

16. The coupling of the electric table stand of claim 15, wherein the shaft rod section is connected to a fastener at one side of the shaft rod section away from the joint section, the half-housing member externally encloses the shaft member and is blocked by the fastener, and the flexible body is enclosingly disposed at an outer circumferential surface of the shaft rod section and is flexibly disposed between the joint section and the half-housing member.

17. The coupling of the electric table stand of claim 14, wherein a through hole is formed at a center of the half housing.

18. The coupling of the electric table stand of claim 14, wherein an axial hole passing through the shaft rod section and the joint section is disposed at a center of the shaft member.

19. The coupling of the electric table stand of claim 14, wherein the second joint further includes a half-housing member, a plurality of guiding positioning structures are disposed at the half housing, a plurality of protruding pillars extend from an outer circumferential surface of the half-housing member, and each of the protruding pillars is correspondingly engaged with each of the guiding positioning structures.

20. The coupling of the electric table stand of claim 19, wherein an outer circumferential surface of the half housing and the outer circumferential surface of the half-housing member include a plurality of indentations.

21. The coupling of the electric table stand of claim 14, wherein the half housing includes a plurality of guiding positioning structures, the second joint further includes a cylindrical member, the cylindrical member receives the shaft member and the flexible body, a plurality of bumps extend from an outer circumferential edge of the cylindrical member, and each of the bumps is correspondingly engaged with each of the guiding positioning structures.

22. The coupling of the electric table stand of claim 21, wherein the second joint further includes a rod assembly, a plurality of flexible arms are disposed on one end of the cylindrical member away from each of the bumps, the rod assembly includes a rod body and a hollow sleeve, the hollow sleeve includes a narrow section, the rod body is inserted into the shaft member and protrudes out of the cylindrical member, the hollow sleeve correspondingly receives the rod body, and the hollow sleeve is pressed into the cylindrical member for engagement therewith, so that each of the flexible arms is engaged with the narrow section to be positioned.

* * * * *